US005244109A

United States Patent [19]

Mullett et al.

[11] Patent Number: 5,244,109

[45] Date of Patent: Sep. 14, 1993

[54] ADJUSTABLE PLASTIC LID FOR GARBAGE CONTAINER

[75] Inventors: Rodney M. Mullett, Hammond; Daniel G. Tyler, Merrillville, both of Ind.; Jamie P. Kostelyk, Evergreen Park, Ill.

[73] Assignee: Poly-John Enterprises, Inc., Whiting, Ind.

[21] Appl. No.: 947,267

[22] Filed: Sep. 18, 1992

[51] Int. Cl.[5] ..... B65D 51/04

[52] U.S. Cl. ..... 220/287; 220/212; 220/255; 220/342; 220/908

[58] Field of Search ..... 220/287, 23.2, 212, 220/255, 342, 380, 908

[56] References Cited

U.S. PATENT DOCUMENTS

| | | | |
|---|---|---|---|
| 4,151,928 | 5/1979 | Fagliano et al. | 220/343 |
| 4,158,424 | 6/1979 | Carmack | 220/343 |
| 4,342,402 | 8/1982 | Jungles | 220/343 |
| 4,445,623 | 5/1984 | Kolling et al. | 220/343 |
| 4,650,089 | 3/1987 | Sanders | 220/334 |
| 4,949,866 | 8/1990 | Sanders | 220/334 |
| 5,088,616 | 2/1992 | Susko et al. | 220/343 |
| 5,118,005 | 6/1992 | Onodera | 220/501 |
| 5,183,180 | 2/1993 | Hawkins et al. | 220/908 |

*Primary Examiner*—Allan N. Shoap
*Assistant Examiner*—Vanessa Caretto
*Attorney, Agent, or Firm*—Mark I. Feldman

[57] ABSTRACT

A first part of a plastic lid for a garbage container made of metal is secured by a standardized hinge adapter which is installed on one edge of the container. A second part of the plastic lid is slidably adjustable into and out of mating engagement with the first part to form the lid of a selected length. Three different sizes of the second part make the lid fit virtually all known containers. Depending upon the size of the container, two of the two-part slidably adjustable lids may be required to be placed next to each other in order to cover the entire opening in the container. Also, a central bar may be arranged between the two two-part slidably adjustable lids.

12 Claims, 8 Drawing Sheets

FIG. 1
PRIOR ART
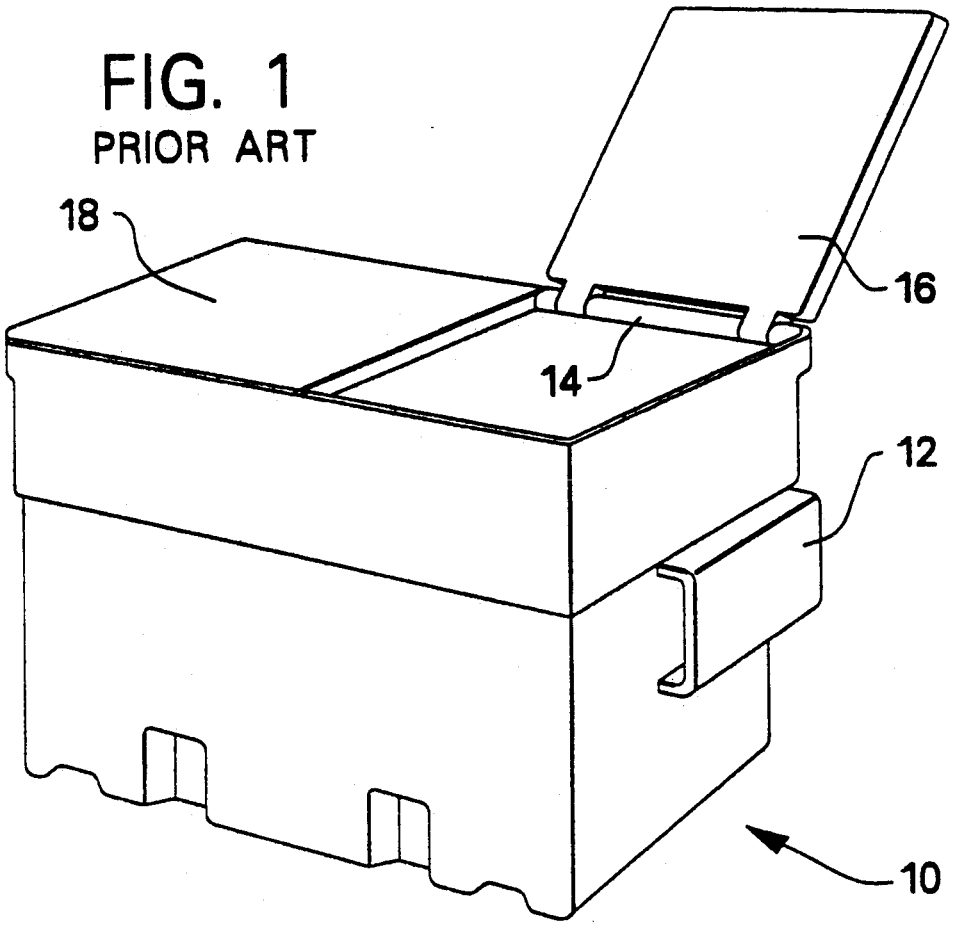
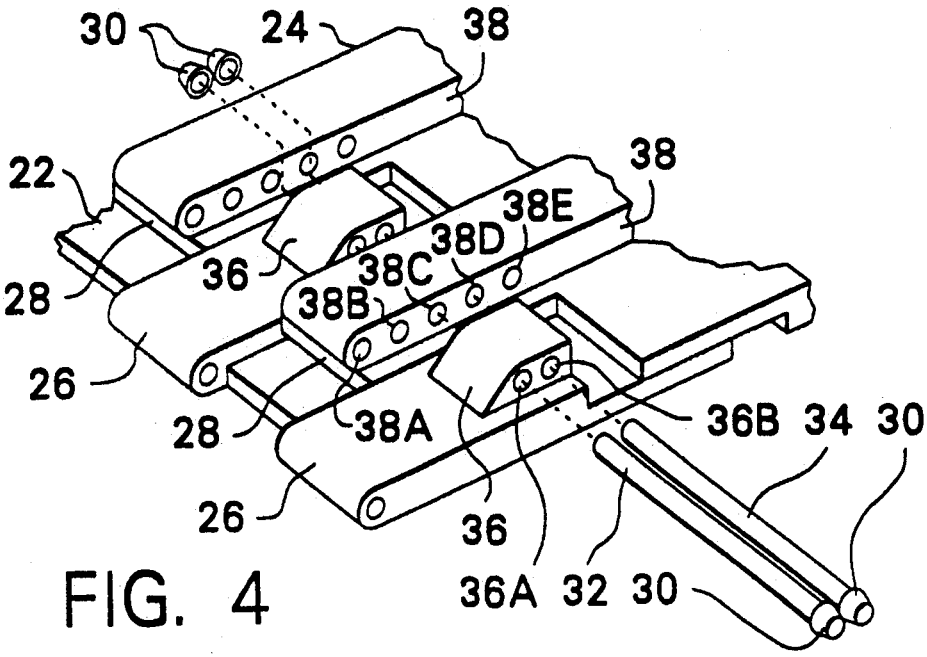
FIG. 4

FIG. 2
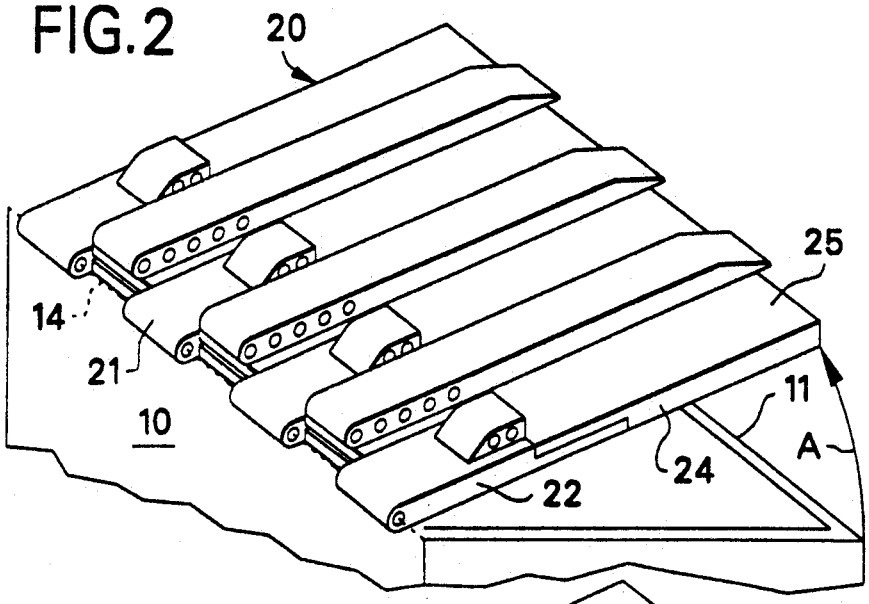
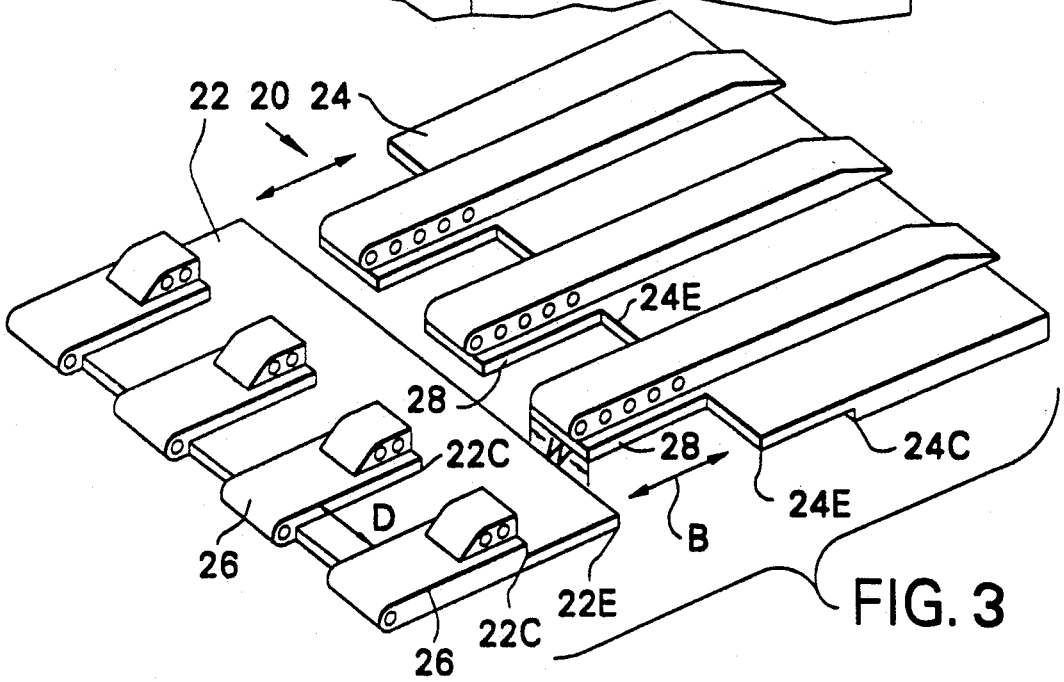
FIG. 3

ADJUSTABLE PLASTIC LID FOR GARBAGE CONTAINER

BACKGROUND OF THE INVENTION

1. Field of the Invention

The invention relates to receptacles generally and, in particular, to closures therefor.

2. Description of Related Art

There are two principal methods for picking up variously sized garbage containers and dumping the contents into a compacting truck. One method uses a so-called rear-loading truck having forks at its back end for picking up a specially designed first type of container with sleeves for receiving the forks along a side away from a hinge for a top closure.

The other method uses a so-called front-loading truck having forks at its front end for picking up a specially designed second type of container, such as the prior art receptable shown in FIG. 1, with sleeves for receiving the forks along a side near to a hinge for a top closure.

Both methods use different containers depending on the frequency and amount of garbage being generated at a given location. Unfortunately, there are no industry standards that specify the dimensions for these containers. Sizes are described as capable of holding either 1.0, 1.5, 2.0, 4.0, 6.0, 8.0, or 10.0 cubic yards of garbage for both methods. Thus, container manufacturers may vary the height, width, and length dimensions of each type of container, as long as the container is capable of holding a certain volume in cubic yards of garbage.

Usually, both types of containers are made from steel and have hinged lids that are made from either steel or plastic. However, most manufacturers of steel containers do not also process plastic for making lids. Thus, a problem exists in the prior art for a plastic processor who makes either original or replacement lids because the size of the opening varies for each different container. Consequently, a plastic processor must have many molds to make differently sized lids to fit all the differently sized containers.

SUMMARY OF THE INVENTION

A container lid is made of plastic and has a common part at a point where the lid is hinged to a steel container. By using two different relatively sliding parts for the plastic lid, most (if not all known) steel containers can be covered.

It is a primary object of the present invention to provide a slidably adjustable lid that reduces the number of molds needed and the amount of inventory in stock for a processor who manufactures plastic lids for steel containers.

It is a secondary object of the present invention that a user may properly fit and cover a given steel container without any overhang of the plastic lid. Because a lid can quite often be caught in a compactor blade of a truck if the lid is longer than the width of the container, the lid can be damaged, thus requiring costly replacement. This disadvantage of prior art lids is overcome by the slidably adjustable lid of the present invention.

These objects and other advantage of the present invention will be better understood after a review of the following drawings in conjunction with a careful study of the subsequently detailed description of the preferred embodiments.

BRIEF DESCRIPTION OF THE DRAWINGS

FIG. 1 is a perspective view of a prior art steel container having two unitary plastic lids, one being opened and another being closed.

FIG. 2 is a perspective rear view of two parts of a first embodiment of a slidably adjustable plastic lid of the present invention in their fully mated positions.

FIG. 3 is an exploded perspective view of the two parts of the first embodiment in their separated positions. FIG. 4 is a partially broken away perspective view of the two parts of the first embodiment being retained in one of several selectively and intermediately extended positions.

DETAILED DESCRIPTION OF THE PREFERRED EMBODIMENTS

Figure 5:
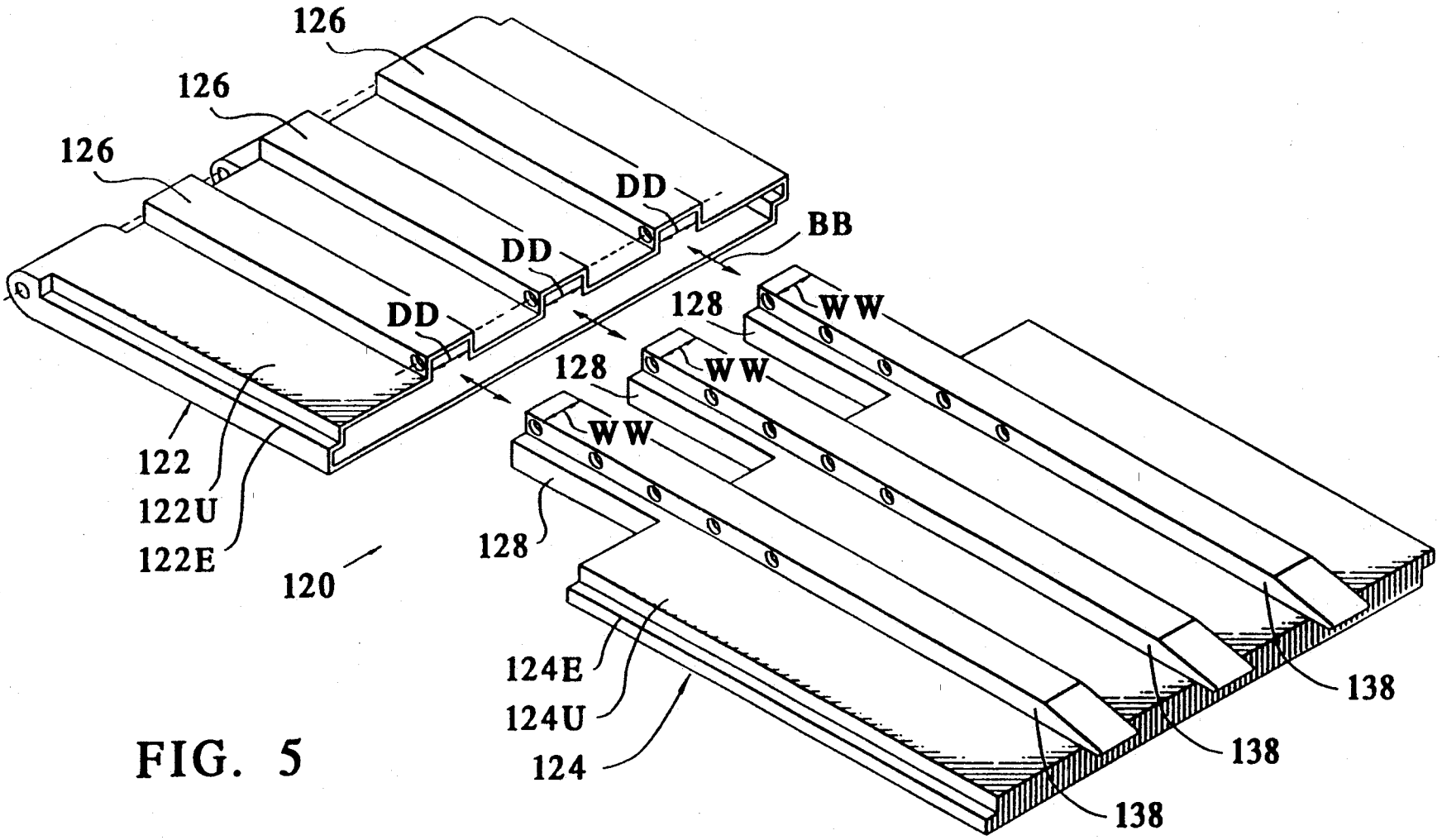
FIG. 5 is an exploded perspective view of the two parts of a second embodiment of the slidably adjustable plastic lid in their separated positions.

In FIG. 1, a prior art steel container 10 holds two cubic yards of garbage and has sleeves 12 for receiving forks of a frontloading truck (not shown). The container 10 also has a hinge bar 14 to which two unitary plastic lids 16 and 18 are attached. One lid 16 is opened while the other lid 18 is closed.

Because the lengths of the lids 16 and 18 are fixed, they cannot be either adjusted or removed for placement on another container 10 having a differently sized top opening.

In FIG. 2, a first embodiment of a slidably adjustable plastic lid 20 of the present invention is shown from its rear. The lid 20 has a hinged portion 21 at one end for attachment to the hinge bar 14, shown only in phantom lines for the sake of simplicity, for securing the lid 20 to the container 10.

The lid 20 of the first embodiment has two lightweight plastic parts 22 and 24 which are shown in their fully mated positions and which rotate together, when engaged, in the direction of an arrow A around the hinge bar 14 to open and close the opening of the container 10. A free end portion 25 of the second lid part 24 closes the container 10 and also overhangs slightly a front edge 11 of the container 10 so that a person may be able to lift easily the assembled lid 20.

In FIG. 3, the two parts 22 and 24 of the first embodiment of the lid 20 are shown in their separated positions. The first lid part 22 has a plurality of stepped corners 22C which mate with a plurality of intermediate edges 24E of the second lid part 24. The first lid part 22 also has a front edge 22E which mates with a stepped corner edge 24C extending across an underside of the second lid part 24. Because the stepped corners 22C are the same distance from the front edge 22E on the first lid part 22 as the corner edges 24C are from the intermediate edges 24E on the second lid part 24, the lid parts 22 and 24 slide under and over each other, respectively, into and out of mating engagement, as indicated by the double-headed arrow B.

Also, in FIG. 3, it is shown that each one of a plurality of raised portions 26 is spaced apart from adjacent raised portions 26 on an upper surface of the first lid part 22. Each raised portion 26 is separated from its adjacent raised portion 26 by an equal distance D.

It is also shown in FIG. 3 that the second lid part 24 has a plurality of protrusions 28, each extending from the intermediate edges 24E and each having an identical width W. The width W is slightly shorter than the distance D so that the protrusions 28 of the second lid part 24 may slide smoothly and directly between the raised portion 26 of the first lid part 22 when the lid parts 22 and 24 are brought into mating engagement.

In FIG. 4, the two lid parts 22 and 24 are retained in one of several selectively and intermediately extended positions. The first lid part 22 has a plurality of blocks 36, each of which sits on top of one of the plurality of raised portions 26. Each block 36 has two holes 36A and 36B drilled or otherwise bored widthwise therethrough.

Similarly, the second lid part 24 has a plurality of elongated portions 38, each of which sits on top of one of the plurality of protrusions 28. Each elongated portion 38 has a plurality of selectable sites which are holes 38A, 38B, 38C, 38D and 38E drilled or otherwise bored widthwise therethrough. Although five holes are shown through the elongated portion 38, more or less holes may be drilled, depending upon the required length of the second lid part 24 needed for the container 10.

Two identical shafts 32 and 34 are passed through simultaneously selected and axially aligned holes to prevent the two lid parts 22 and 24 from hinging about each other. Although only one hole 36A or 36B and only one shaft 32 or 34 should be sufficient to prevent the lid parts 22 and 24 from rotating about each other, both holes 36A and 36B and both shafts 32 and 34 are preferred.

As shown only in FIG. 4, holes 36A and 38C are selected and aligned for the first shaft 32 while adjacent holes 36B and 38D, respectively, are selected and aligned for the second shaft 34.

Both shafts 32 and 34 ar kept in the holes by identical caps 30 which are pushed onto opposite ends of the shafts 32 and 34 to prevent the shafts 32 and 34 from inadvertently slipping out of the selected holes, particularly while contents in the container 10 are being dumped into the truck (not shown).

The length of the assembled lid 20 for the first embodiment is determined in the following manner. A user first measures the length of the container 10 in FIG. 1. Then, the user chooses one of three differently sized lid parts 24. Although only one lid part 24 is shown in FIGS. 2–4, the manufacturer should need to have available only three different sizes, i.e. one having an adjustable range of 36 to 44 inches, a second having an adjustable range of 44 to 52 inches, and a third having an adjustable range of 52 to 60 inches.

After a lid part 24 is selected with a length sufficient to close the opening in the measured container 10, a standardized hinge adapter (not shown) is installed on a rear edge of the container 10. Then, the first lid part 22 is mated with the sufficiently long lid part 24 by sliding the parts 22 and 24 together, as seen in FIG. 3. The parts 22 and 24 are then fixed relative to each other by inserting the two shafts 32 and 34 into the aligned holes 36A, 38C and 36B, 38D, respectively, as seen only in FIG. 4. Thereafter, the caps 30 are pushed onto the opposite ends of the two shafts 32 and 34.

Next, the assembled lid 20 is placed on top of the container 10, as shown in FIG. 2, and the hinge bar 14 is inserted into the standardized hinge adapter to secure the lid 20 onto the container 10. Usually, two assembled lids 20 are required side by side to complete the closure on the top opening of the container 10.

Although the container 10 is illustrated in FIG. 1 as a frontloading type, the assembled lid 20 may be used for rear-loading containers also. Furthermore, the assembled lid 20 is not restricted to garbage containers, but can be used on any type of large container.

A so-called overlap joint is formed by the mating of the stepped corner 22C with the intermediate edge 24E and by the simultaneous mating of the front edge 22E with the stepped corner 24C. One advantage of this joint is the prevention of water and pests from entering the container 10 and likewise the prevention of odors and loose debris from leaving the container 10. Although the corners 22C, 24C and the edges 22E, 24E are shown in FIG. 3 to have sharp points, they may instead be slightly rounded to prevent accidental injuries to users.

The advantage of the overlapping joint is particularly important in regard to preventing the entry of water because landfill operators are starting to charge garbage haulers by the weight of their loads and no longer by their volume in cubic yards. Water would unnecessarily make the garbage load in the truck weigh much more.

Because of the lightweight plastic which is used to make the lid parts 22 and 24, the assembled lid 20 weighs much less than the standard metal and heavy plastic lids known in the prior art. As our population ages, this advantage will become more important at retirement communities, particularly in cold areas where snow is likely to accumulate on top of the assembled lid 20. A preferred lightweight plastic is polyethylene.

Another advantage of the lightweight plastic lid 20 is that the loading and unloading of the garbage into and out of the container 10 is a much quieter operation, when compared to any container 10 having a heavy metal lid of the prior art. This advantage should be appreciated by almost everyone, especially during the early morning hours when most such operations occur.

The assembled lids 20 will be made with either a double wall, which is most necessary for front-loaded containers, or a single wall, which is more suitable for rear-loaded containers.

Also, the rib structure of the assembled lid 20 can support a minimum of 125 lbs. of static weight. This strength is sufficient to support a child in the event that one climbs on top of the lid 20. Thus, the child will be prevented from falling into the container 10, thereby eliminating possible injuries and reducing liability insurance premiums for owners.

The plastic material used to make the lid 20 would be stabilized to resist weathering and also to have both high and low temperature impact resistance.

In FIG. 5, two parts 122 and 124 of a second embodiment of a lid 120 are shown in their separated positions. Because the first lid part 122 is hollow, the second lid part 124 slides into and out of mating engagement with the hollowed first lid part 122, as indicated by the double-headed arrow BB. Also, in FIG. 5, it is shown that each one of a plurality of raised portions 126 is hollow and has an internal dimension DD.

Furthermore, it is shown in FIG. 5 that the second lid part 124 has a plurality of protrusions 128 and a plurality of elongated portions 138, each having an identical width WW. The width WW is slightly shorter than the internal dimension DD so that the elongate portions 138 of the second lid part 124 may slide smoothly and directly into the raised hollow portions 126 of the first lid part 122 when the lid parts 122 and 124 are brought into mating engagement. The elongated portions 138 also have a plurality of aligned holes bored widthwise therethrough.

Figure 6:
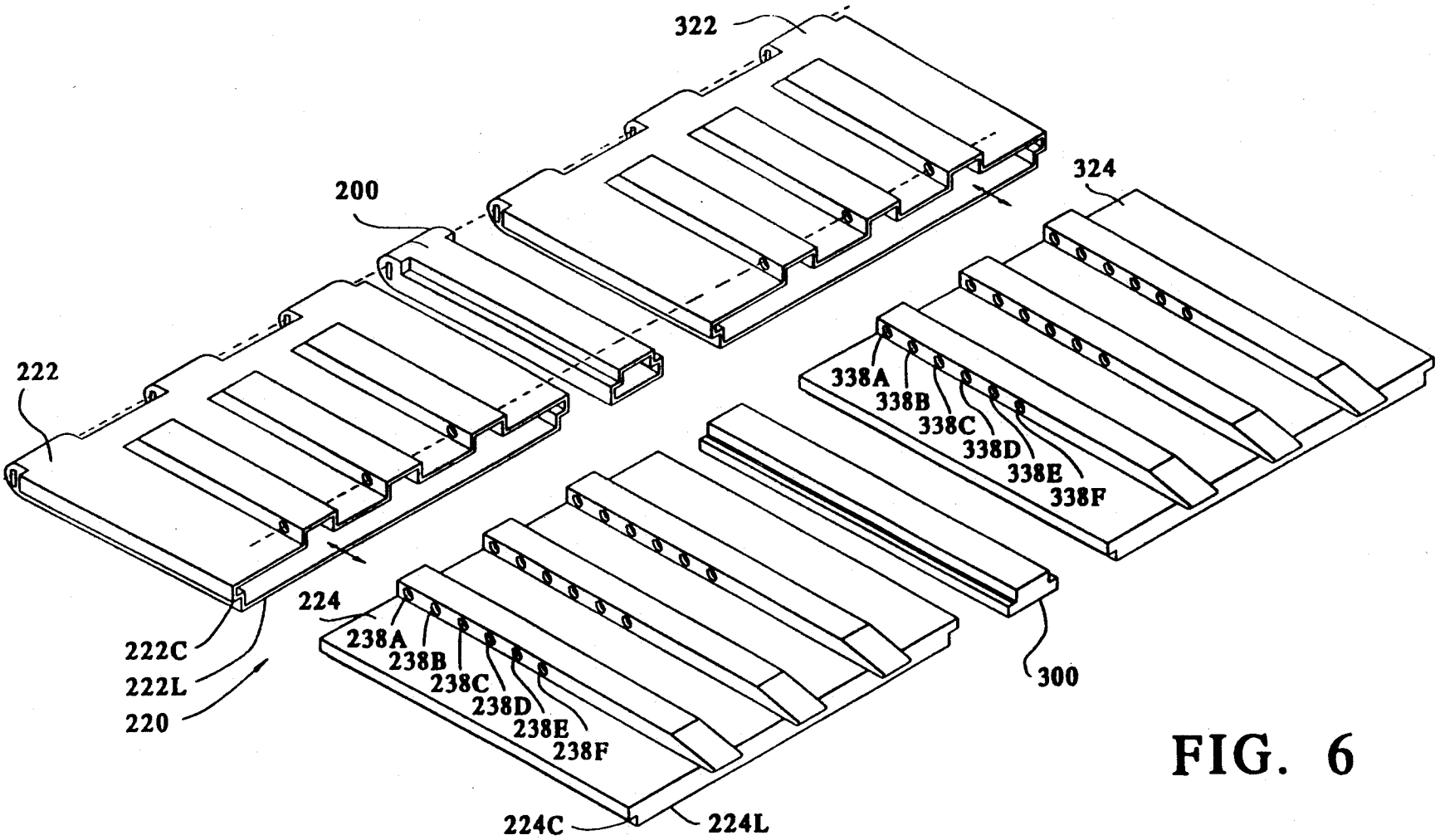
FIG. 6 is an exploded perspective view of six parts of a third embodiment of the slidably adjustable plastic lid in their separated positions.
Figure 7:
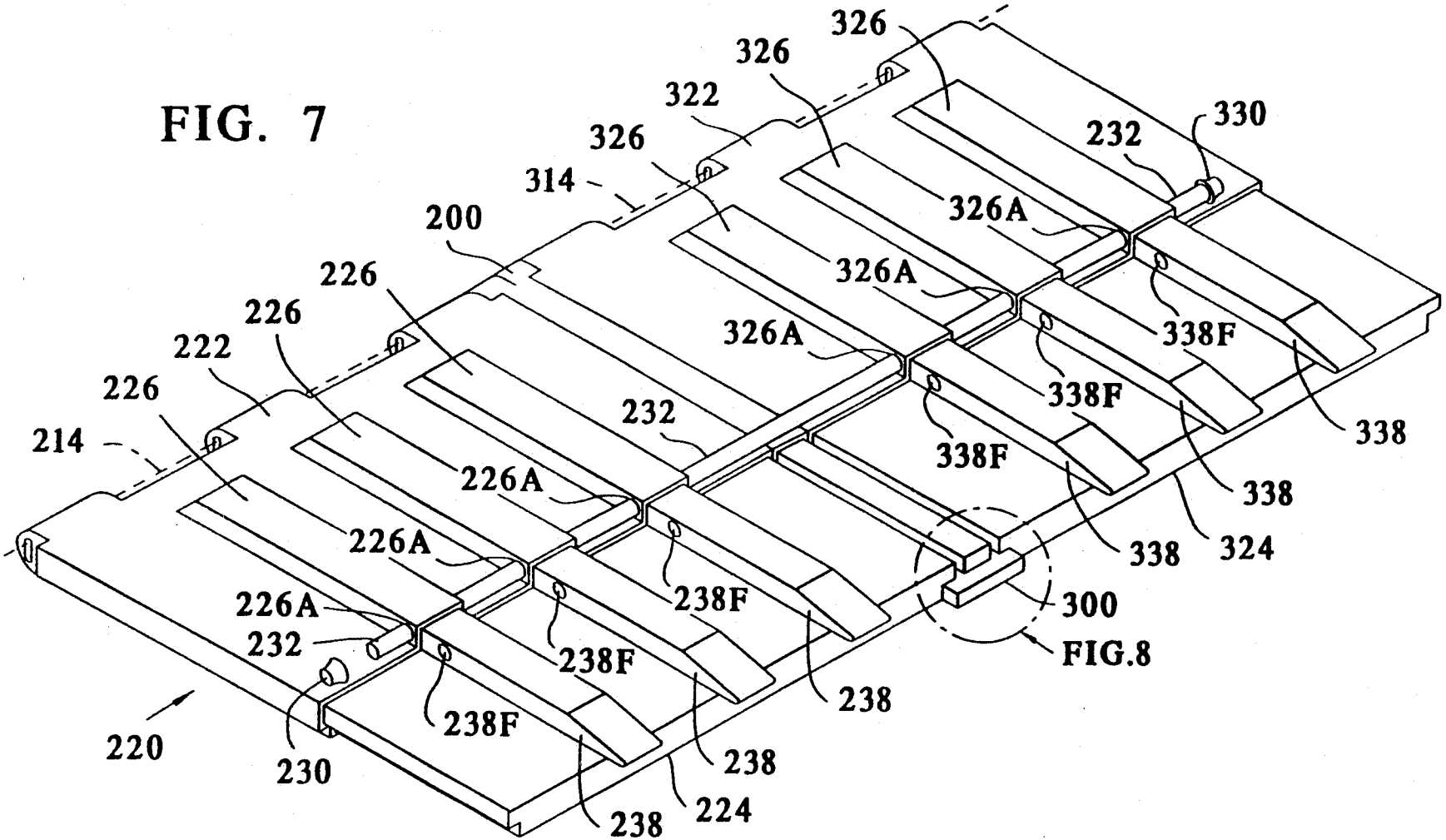
FIG. 7 is a perspective view of the six parts of the third embodiment in their fully mated positions.
Figure 8:
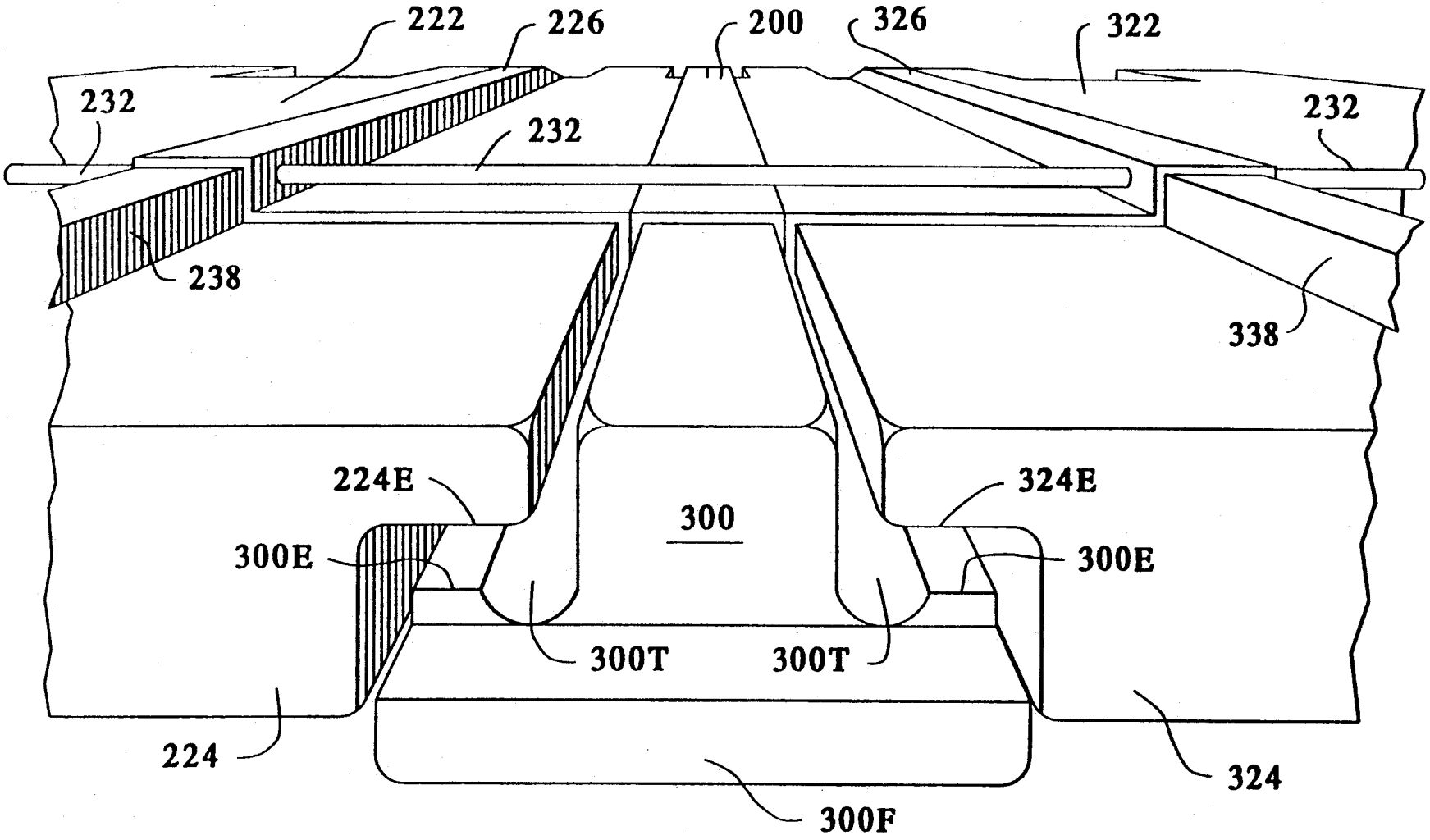
FIG. 8 is an enlarged view of details circled in FIG. 7.

A comparison of the two-part second embodiment of FIG. 5 with a six-part third embodiment of FIGS. 6–8 will reveal that the two-part second embodiment is virtually identical to two leftmost lid parts 222 and 224 of the third embodiment, as best shown in FIG. 6, except that two leftmost edges 122E and 124E of the two lid parts 122 and 124 of the second embodiment are a step down from upper surfaces 122U and 124U thereof whereas two leftmost corners 222C and 224C of the two lid parts 222 and 224 of the third embodiment are a step up from lower surfaces 222L and 224L thereof. Otherwise, the remaining elements of the second embodiment shown in FIG. 5 are identical to the elements of the two leftmost lid parts 222 and 224 of the third embodiment.

Because of the virtual identicalness of the second embodiment shown in FIG. 5 with the two leftmost lid parts 222 and 224 of the third embodiment shown in FIGS. 6–8, the operation and use of the second embodiment will be subsumed under the description of the operation and use of the third embodiment.

In FIG. 6, the six parts of the third embodiment of a slidably adjustable plastic lid 220 ar illustrated in their separated positions. The lid 220 includes the leftmost upper lid part 222, the leftmost lower lid part 224, a central upper bar 200, a central lower bar 300, a rightmost upper lid part 322, and a rightmost lower lid part 324.

In FIG. 7, the six lid parts are retained in one of several selectively and intermediately extended positions. The upper lid parts 222 and 322 have a plurality of raised hollow portions 226 and 326, each of which has one hole 226A and 326A, respectively, drilled or otherwise bored widthwise therethrough.

Similarly, the lower lid parts 224 and 324 have a plurality of elongated portions 238 and 338. Each elongated portion 238 and 338 has a plurality of selectable sites which are holes drilled or otherwise bored widthwise therethrough.

Although five holes are shown through an elongated portion 138 in the second embodiment of FIG. 5, more or less holes may be drilled in the fourth embodiment of FIGS. 6–8, depending upon the required length of the lower lid parts 224 and 324 needed to cover the container 10 shown in FIG. 1.

For example, although only holes 238F and 338F are visible in the elongated portions 238 and 338 in FIG. 7, there are five other pairs of holes 238A–E and 338A–E which are shown only in FIG. 6 because they are hidden inside the raised hollow portions 226 and 326 in FIG. 7.

A single shaft 232 is passed through simultaneously selected and axially aligned holes to prevent the six lid parts from hinging about each other. On the left side of the central upper bar 200, only one hole 226A is aligned with a hidden hole adjacent to the hole 238E for the shaft 232 to pass therethrough, thus preventing the leftmost lid parts 222 and 224 from rotating about each other. On the right side of the central upper bar 200, only one hole 326A is aligned with a hidden hole adjacent to the hole 338F for the shaft 232 to pass therethrough, thus also preventing the rightmost lid parts 322 and 324 from rotating about each other.

The shaft 232 is kept in the holes by identical caps 230 and 330 which are pushed onto opposite ends of the shaft 232 to prevent the shaft 232 from inadvertently slipping out of the selected holes, particularly while contents in the container 10 of FIG. 1 are being dumped, after the six lid parts are lifted and rotated about rear hinge bars 214 and 314.

For an explanation of the details of the central lower bar 300 circled in FIG. 7, reference will now be made to FIG. 8. The lower bar 300 has side edges 300E which support edge 224E of the left lid part 224 and edge 324E of the right lid part 324. The lower bar 300 slides into and out of the upper bar 200 so as to adjust the center bar to a desired length. The lower bar 300 may be gripped by a user at a front edge 300F and pushed upwardly so that all six lid parts 200, 300, 222, 224, 322 and 324 are raised at the same time, thus allowing the user to throw garbage, trash and other debris into the opening provided for access to the interior of the container 10 shown in FIG. 1.

The bar 300 also has troughs 300T cut lengthwise into the side edges 300E so that water is drained from the upper surfaces of the six lid parts 200, 300, 222, 224, 322 and 324. Thus, instead of falling into the container 10 and increasing the weight of its contents, water is drained into the troughs 300T and over the front edge 300F of the lower bar 300 onto the ground outside of the container 10.

The lengths of the assembled lid 120 for the second embodiment shown in FIG. 5 and of the assembled lid 220 for the third embodiment shown in FIG. 7 are determined in a manner similar to the determination of the length of the assembled lid 20 for the first embodiment shown in FIG. 2, except that the second and third embodiments have the extra central bars 200 and 300 not used in the first embodiment. Also, the second and third embodiments have only the single shaft 232 whereas the first embodiment has two parallel shafts 32 and 34 for preventing rotation of the lid parts about each other.

Figures 9, 11:
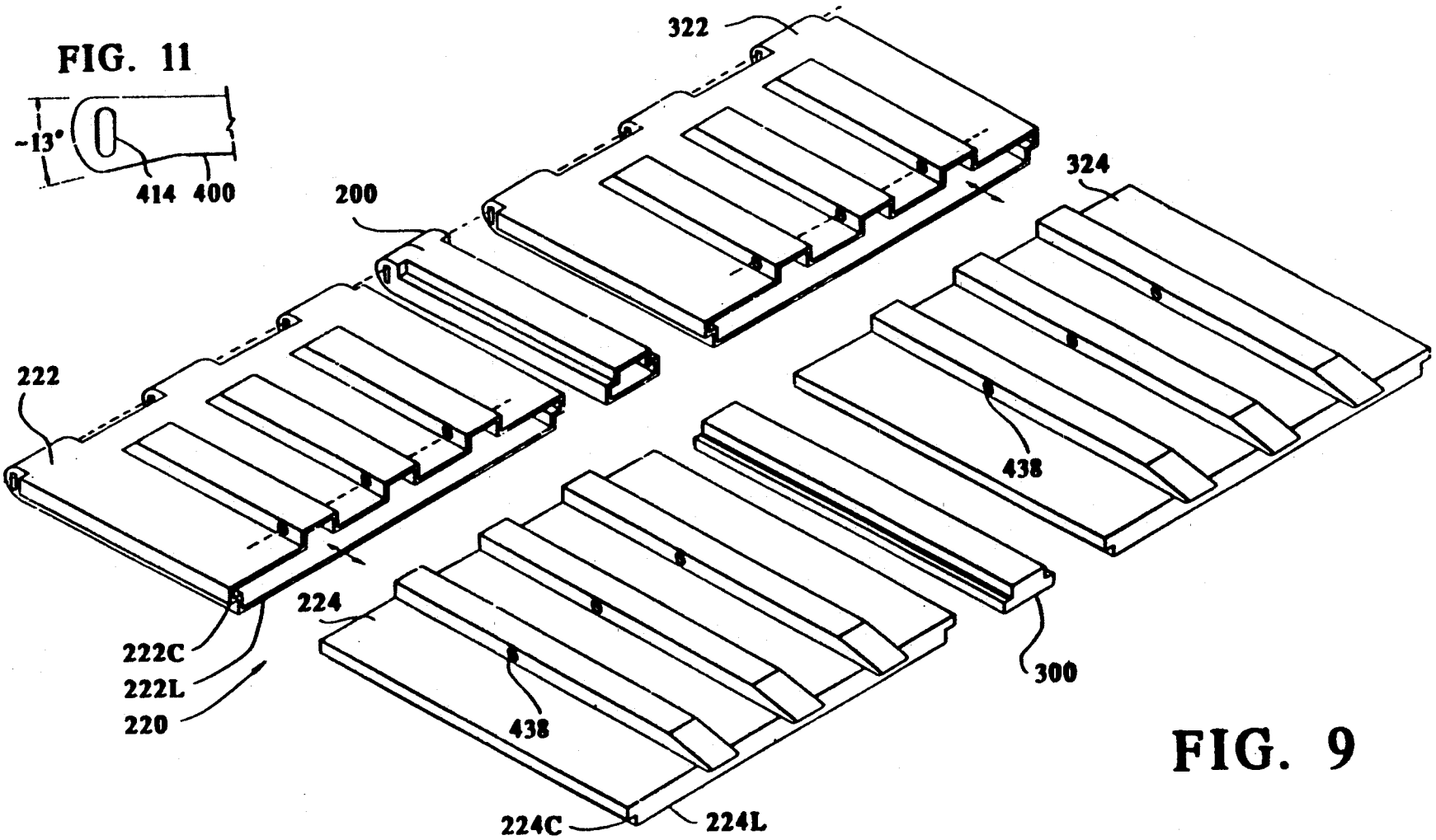
FIG. 9 is an exploded perspective view of six parts of a fourth embodiment of the slidably adjustable plastic lid in their separated positions.
FIG. 11 is an enlarged view of details circled in FIG. 10.

In FIG. 9, six parts of a fourth embodiment of a slidably adjustable plastic lid 220 are illustrated in their separated positions. Similarly to the third embodiment shown in FIGS. 6–8, the lid 220 of this fourth embodiment includes the leftmost upper lid part 222, the leftmost lower lid part 224, a central upper bar 200, a central lower bar 300, a rightmost upper lid part 322, and a rightmost lower lid part 324.

Figure 10:
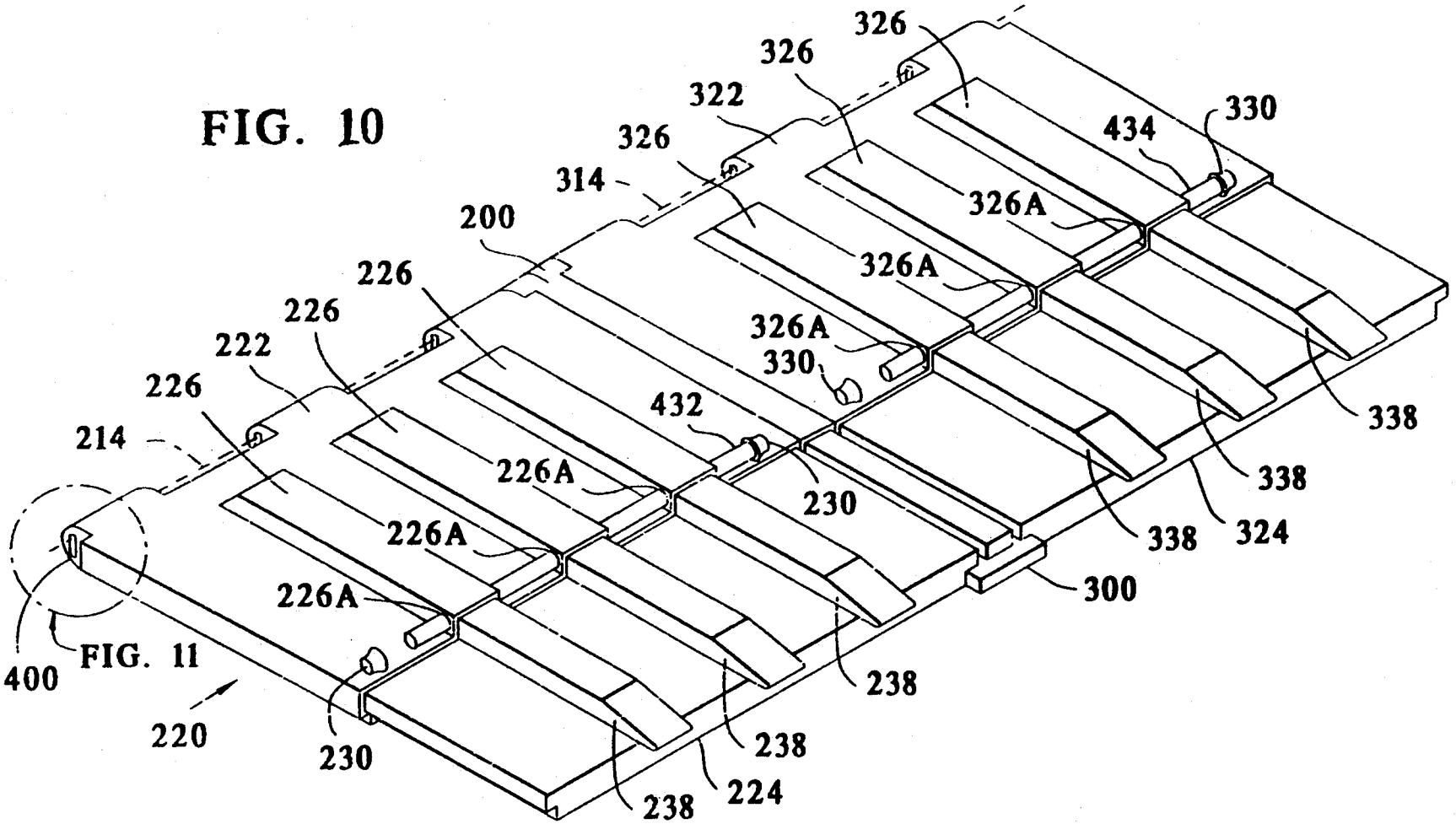
FIG. 10 is a perspective view of the six parts of the fourth embodiment in their fully mated positions.

In FIG. 10, the six lid parts of the fourth embodiment are retained in one of several selectively and intermediately extended positions. The upper lid parts 222 and 322 have a plurality of raised hollow portions 226 and 326, each of which has one hole 226A and 326A, respectively, drilled or otherwise bored widthwise therethrough.

Similarly, the lower lid parts 224 and 324 have a plurality of elongated portions 238 and 338. Each elongated portion 238 and 338 has a plurality of selectable sites which are holes drilled or otherwise bored widthwise therethrough.

Although five holes are shown through an elongated portion 138 in the second embodiment shown in FIG. 5, more or less holes may be drilled in the fourth embodiment of FIGS. 9-11, depending upon the required length of the lower lid parts 224 and 324 needed to cover the container 10 shown in FIG. 1.

For example, although only a pair of holes 438 is visible in the lower lid parts 224 and 324 in FIG. 9, there may be as many as five other pairs of holes, such as the holes 238A-E and 338A-E which are shown only in FIG. 6 of the third embodiment, because they are hidden inside the raised hollow portions 226 and 326 in FIG. 10.

Two axially aligned shafts 432 and 434 are passed through simultaneously selected and axially aligned holes to prevent the six lid part from hinging about each other. On the left side of the central upper bar 200, only one hole 226A is aligned with a hidden hole for the first shaft 432 to pass therethrough, thus preventing the leftmost lid parts 222 and 224 from rotating about each other. On the right side of the central upper bar 200, only one hole 326A is aligned with a hidden hole for the second shaft 434 to pass therethrough, thus also preventing the rightmost lid parts 322 and 324 from rotating about each other.

The first shaft 432 is kept in the holes by identical caps 230 while the second shaft 434 is kept in the holes by identical caps 330 which are pushed onto opposite ends of the shafts 432 and 434 to prevent the shafts 432 and 434 from inadvertently slipping out of the selected holes, particularly while contents in the container 10 of FIG. 1 are being dumped, after the six lid parts are lifted and rotated about rear hinge bars 214 and 314.

Alternatively, a plurality of blind rivets (not shown), each of which has a short length, may be substituted for the shafts 432 and 434. The same holding purpose of the shafts 432 and 434 may be accomplished by simply popping a blind rivet into each hole 226A and 326A of FIG. 10 while in mating engagement with each corresponding hole 438 of FIG. 9.

For an explanation of the details of the slotted hinge 400 circled in FIG. 10, reference will now be made to FIG. 11. The hinge 400 has a widened portion which forms a downwardly extending angle of about 13° from a horizontal axis passing through the hinge 400. The widened portion of the hinge 400 also includes an elongated slot 414 positioned s that its major axis is vertically oriented.

As shown in FIG. 10, the hinge bars 214 and 314 are slipped through the slotted hinge 400 so as to mount the assembled lid 220 to the container 10 shown in FIG. 1. Since manufacturers of the containers 10 use different types of hinge supports to mount the assembled lid 220 to the container 10, the elongated hole 414 of FIG. 11 and its position in the hinge 400 allows the assembled lid 220 of the present invention to fit most, if not all, containers 10 currently in use.

A key advantage of the elongated hole 414 of FIG. 11 in the slotted hinge 400 is that the assembled lid 220 is allowed to float freely in order to absorb any pinch-point shock which is usually inflicted when a user inadvertently drops the assembled lid 220 on his or her fingers.

Furthermore, another advantage of the elongated hole 414 of the hinge 400 is that the freely floating lid 220 is allowed to open and close easily when the six parts of FIG. 9 are nested together.

The lengths of the assembled lid 120 for the second embodiment shown in FIG. 5 and of the assembled lid 220 for the fourth embodiment shown in FIG. 9 are determined in a manner similar to the determination of the length of the assembled lid 20 for the first embodiment shown in FIG. 2, except that the second and fourth embodiments have the extra central bars 200 and 300 not used in the first embodiment. Also, the fourth embodiment has two axially aligned shafts 432 and 434 whereas the first embodiment has two parallel shafts 32 and 34 for preventing rotation of the lid parts about each other.

From the foregoing detailed description of the four preferred embodiments, it should be apparent to those skilled in the art of manufacturing large plastic lids that other constructions and modifications may be made and will be considered within the scope of the invention.

Therefore, it should be understood that the invention is not limited to the four embodiments described above, but rather is defined by the scope of the following claims.

What we claim as our invention is as follows:

1. An assembled lid for a container having a hinge at one end and a front edge at another end, said assembled lid comprising:

a. a first lid part having a hinged means for securing the first lid part to one end of the container, said first lid part also having an engagable portion;

b. a second lid part having a free end for closing the container and also having a means for mating at a plurality of selectable sites with the engagable portion of the first lid part; and c. means for retaining the mating means of the second lid part in nonhinged engagement at a selected one of the selectable sites with the engagable portion of the first lid part;

whereby the assembled lid has a length determined by the selected on of the selectable sites.

2. The assembled lid, according to claim 1, wherein: said engagable portion of the first lid part includes a plurality of stepped corners, a front edge, a plurality of raised portions spaced from each other, a plurality of blocks, one each sitting atop each one of the raised portions, and at least one hole bored widthwise through each one of the blocks.

3. The assembled lid, according to claim 2, wherein: said mating means of the second lid part includes a plurality of intermediate edges, a stepped corner edge extending across an underside thereof, a plurality of protrusions being spaced from each other and extending from the intermediate edges, a plurality of elongated portions, one each sitting atop each one of the protrusions, and a plurality of holes being bored widthwise through each one of the elongated portions and also being selectively alignable with at least one hole through each block of the first lid part.

4. The assembled lid, according to claim 3, wherein: said retaining means includes at least one shaft being passable through at least one hole bored through each block of the first lid part and also being passable through one of the selectively alignable holes bored through each elongated portion of the second lid part.

5. The assembled lid, according to claim 4, further comprising:

cap means for preventing at least one shaft from slipping out of both the one hole and the holes selectively alignable therewith.

6. The assembled lid, according to claim 1, wherein:

said engagable portion of the first lid part includes a plurality of stepped edges, a plurality of raised hollow portions spaced from each other, and one hole bored widthwise through each of the raised hollow portions.

7. The assembled lid, according to claim 6, wherein:

said mating means of the second lid part includes a plurality of stepped edges, a plurality of protrusions being spaced from each other, a plurality of elongated portions, one each sitting atop each one of the protrusions, and a plurality of holes being bored widthwise through each one of the elongated portions and also being selectively alignable with the one hole through each raised hollow portion of the first lid part.

8. The assembled lid, according to claim 7, wherein:

said retaining means includes at least one shaft being passable through the one hole bored through the raised hollow portion of the first lid part and also being passable through one of the selectively alignable holes bored through each elongated portion of the second lid part.

9. The assembled lid, according to claim 8, further comprising:

cap means for preventing at least one shaft from slipping out of both the one hole and the holes selectively alignable therewith.

10. The assembled lid, according to claim 1, further comprising:

d. central bar means, hinged to one end of the container, for simultaneously lifting the first lid part and the second lid part from the front edge of the container when the container is emptied.

11. The assembled lid, according to claim 10, wherein:

said central bar means includes trough means for allowing drainage of water and the like therefrom.

12. The assembled lid, according to claim 1, wherein:

said hinged means is slotted and includes an elongated hole means for allowing the first lid part to float freely.

* * * * *